US012704356B2

(12) United States Patent
Planck et al.

(10) Patent No.: US 12,704,356 B2
(45) Date of Patent: Aug. 11, 2026

(54) FIREARM ACCESSORY MOUNTING STRUCTURE

(71) Applicant: Crimson Trace Corporation, Columbia, MO (US)

(72) Inventors: William A. Planck, Columbia, MO (US); Tim Meissen, Columbia, MO (US); Michael Cottrell, Ashland, MO (US); Ryan Donahue, Columbia, MO (US); John Oller, Columbia, MO (US); James Tayon, Moberly, MO (US)

(73) Assignee: Crimson Trace Corporation, Columbia, MO (US)

( * ) Notice: Subject to any disclaimer, the term of this patent is extended or adjusted under 35 U.S.C. 154(b) by 13 days.

(21) Appl. No.: 19/047,690

(22) Filed: Feb. 7, 2025

(65) Prior Publication Data

US 2025/0180334 A1 Jun. 5, 2025

Related U.S. Application Data

(63) Continuation of application No. 17/962,435, filed on Oct. 7, 2022, now Pat. No. 12,253,333.

(60) Provisional application No. 63/262,219, filed on Oct. 7, 2021.

(51) Int. Cl.
*F41G 11/00* (2006.01)
*F41G 1/30* (2006.01)

(52) U.S. Cl.
CPC ..... *F41G 11/001* (2013.01); *F41G 1/30* (2013.01)

(58) Field of Classification Search
CPC ..... F41G 11/001; F41G 1/30
USPC ..... 42/118
See application file for complete search history.

(56) References Cited

U.S. PATENT DOCUMENTS

| | | | |
|---|---|---|---|
| 6,327,806 | B1 | 12/2001 | Paige |
| 8,011,130 | B2 | 9/2011 | Chang et al. |
| 8,082,688 | B2 | 12/2011 | Elpedes et al. |
| 8,099,897 | B2 | 1/2012 | Elpedes et al. |
| 8,215,050 | B2 | 7/2012 | Elpedes et al. |
| 8,443,541 | B2 | 5/2013 | Elpedes et al. |
| 10,352,654 | B2 | 7/2019 | Costet et al. |
| 10,907,932 | B2 * | 2/2021 | Curry ..... F41G 1/30 |

(Continued)

FOREIGN PATENT DOCUMENTS

| | | | |
|---|---|---|---|
| EP | 2228617 | A2 | 2/2010 |
| WO | 2013003873 | A1 | 1/2013 |
| WO | 2021040978 | A2 | 3/2021 |

OTHER PUBLICATIONS

Online product page for "Universal Optic Converter Plate to convert any Optic Cut/Plate with Trijicon RMR/SRO Footprint to Accept over 25 popular red dot brands such as ADE RD3 Series, Vortex Venom/Viper, Burris Fastfire, Shield RMS/RMSC, Sig Sauer Romeo Zero Red dot Sight"; https://opticsfactory.com/ (Year: 2025).*

(Continued)

*Primary Examiner* — Samir Abdosh
(74) *Attorney, Agent, or Firm* — Stionson LLP

(57) ABSTRACT

A firearm accessory and associated components and methods. The firearm can be a firearm sight, such as a red dot type sight. The firearm accessory includes a base configured to mount to at least first and second different mounting adaptors to permit selective mounting of the firearm accessory to a firearm via the first mounting adaptor or the second mounting adaptor.

20 Claims, 9 Drawing Sheets

(56) References Cited

U.S. PATENT DOCUMENTS

| | | | | |
|---|---|---|---|---|
| 11,002,517 | B1 * | 5/2021 | Holly | F41G 1/30 |
| 11,761,731 | B2 * | 9/2023 | Niswander | F41G 1/02 42/111 |
| 2016/0209176 | A1 * | 7/2016 | Zimmer | F41G 11/001 |
| 2017/0184375 | A1 * | 6/2017 | Huff | F41G 11/003 |
| 2019/0049217 | A1 * | 2/2019 | Costet | F41G 1/16 |
| 2019/0257620 | A1 * | 8/2019 | Zimmer | F41C 3/00 |
| 2021/0033372 | A1 | 2/2021 | Zimmer | |
| 2021/0270572 | A1 * | 9/2021 | Dawson, Jr. | F41G 11/001 |
| 2021/0318099 | A1 * | 10/2021 | Holly | F41G 11/002 |
| 2023/0117500 | A1 * | 4/2023 | Dawson, Jr. | F41G 11/001 42/111 |

OTHER PUBLICATIONS

Online product page for "ohhunt® Universal Shotgun Rib Mount Plate for Docter/Noblex Footprint Red Dot Sights"; https:// www.ohhunt.com (Year: 2025).*

* cited by examiner

FIREARM ACCESSORY MOUNTING STRUCTURE

CROSS-REFERENCE TO RELATED APPLICATION

The present application claims priority to and is a continuation of U.S. patent application Ser. No. 17/962,435, filed Oct. 7, 2022, which claims priority to U.S. Provisional Patent App. No. 63/262,219, filed Oct. 7, 2021, the entireties of which are hereby incorporated by reference.

FIELD

The present disclosure generally relates to firearm accessories, and more particularly to mounting structure for firearm accessories.

BACKGROUND

Firearm accessories mount to firearms in various ways. Improvements are needed.

SUMMARY

In one aspect, a firearm sight is selectively usable with at least a first mounting adaptor and a second mounting adaptor for connecting the firearm sight to a firearm. The first mounting adaptor has a first firearm sight connection structure, and the second mounting adaptor has a second firearm sight connection structure differently configured compared to the first firearm sight connection structure. The firearm accessory comprises a base including mount connection structure configured to selectively connect to the first firearm sight connection structure and the second firearm sight connection structure to permit mounting of the firearm sight on a firearm using the first mounting adaptor or the second mounting adaptor. The firearm sight includes a sighting portion supported by the base. The sighting portion is configured to assist a shooter of the firearm in aiming the firearm.

Other objects and features of the present disclosure will be in part apparent and in part pointed out herein.

BRIEF DESCRIPTION OF THE DRAWINGS

Corresponding reference numbers indicate corresponding parts throughout the drawings.

DETAILED DESCRIPTION

Figure 1:
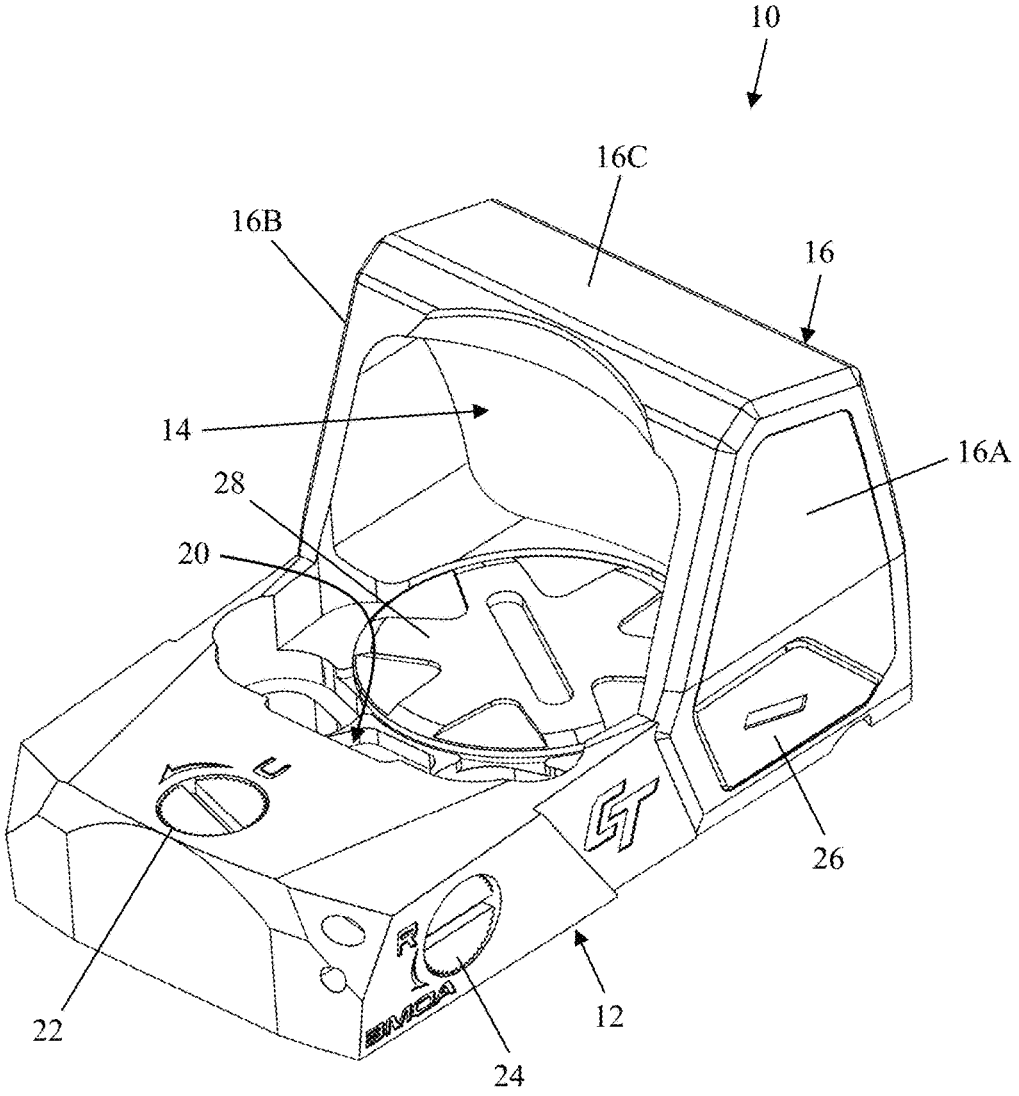
FIG. 1 is a rear perspective of a firearm accessory of the present disclosure.
Figure 2:
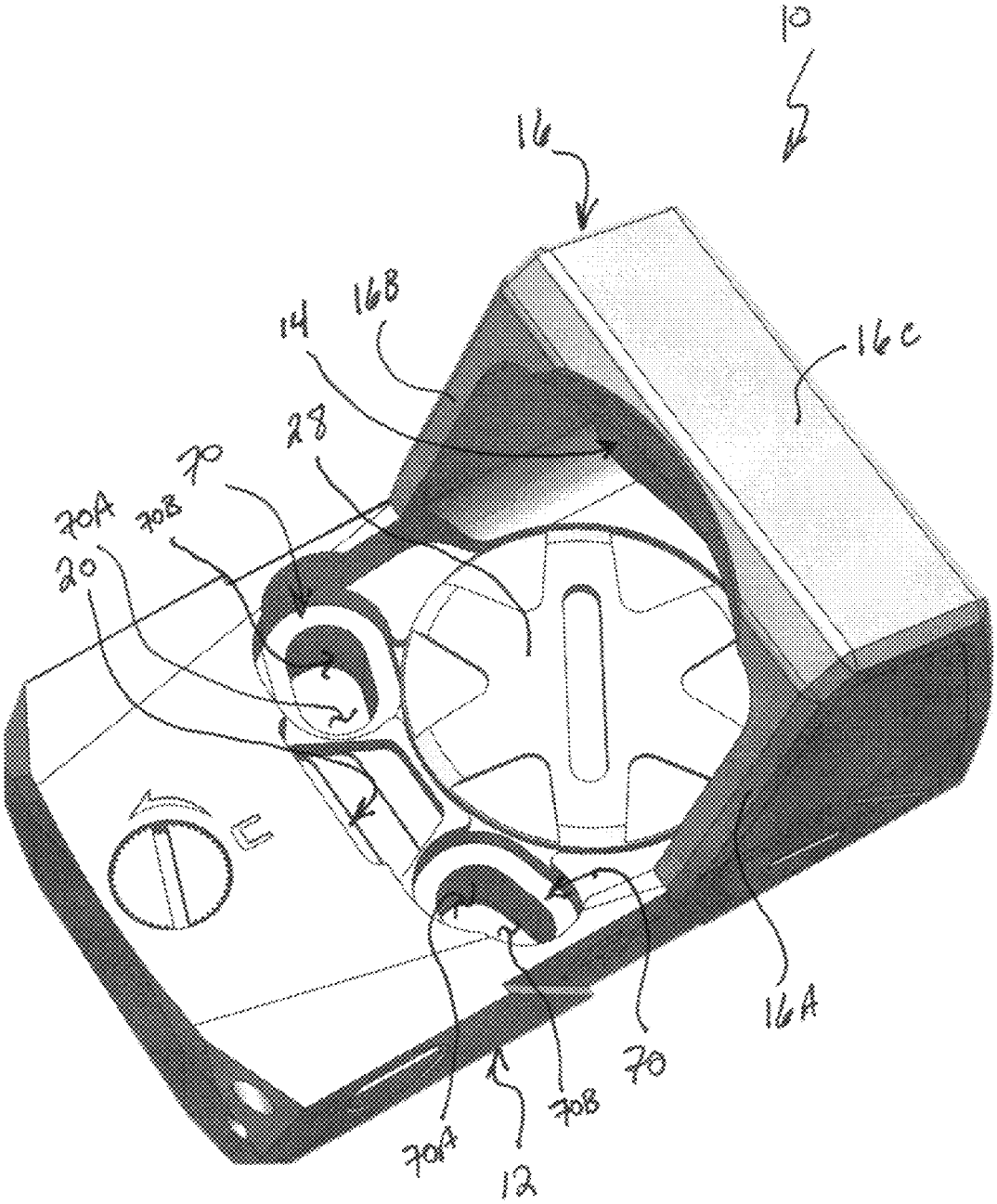
FIG. 2 is a top perspective of the firearm accessory.

Referring to FIG. 1, a firearm sight of the present disclosure is indicated by 10. In the illustrated embodiment, the firearm sight is a "red dot" type sight configured to assist a shooter in aiming a firearm at a target. It will be appreciated that aspects of the present disclosure can be implemented on other firearm accessories (e.g., other types of firearm sights) without departing from the scope of the present disclosure. The firearm sight 10 can be referred to broadly as a firearm accessory.

In general, the firearm sight 10 comprises a base 12, an optical lens 14, and a lens support 16. The base 12 is a generally rectangular structure having a forward end adjacent the lens 14 and having an opposite rear end. The base 12 is configured to be connected to a firearm, as described in further detail below. The lens 16 is arranged to permit a shooter to look through the lens when aiming the firearm. It will be appreciated that the firearm sight 10 includes a light source 20 housed in the rear portion of the base 12 that is configured to emit light forward toward the lens 14 to be reflected rearward to be seen by the shooter when the shooter is looking through the lens, as is common with red dot type sights. The reflected light (e.g., having the appearance of a red dot) is adjustable to locate the dot to correspond to a correct aiming point of the firearm to sight in or zero the firearm. For example, a first dial 22 (broadly, vertical adjustment actuator) can be used to change a vertical position of the dot as seen by the shooter, and a second dial 24 (broadly, horizontal adjustment actuator) can be used to change a horizontal position of the dot as seen by the shooter. Various actuators 26 can be used to turn the light source on and off and to change a brightness level of the light source. A battery (broadly, power source) is held in a battery compartment under a battery cover 28 and is operatively connected to the light source 20 for powering the light source responsive to actuation of the actuators 26. Such configurations are known in the field and will not be described in further detail herein.

The lens support 16 extends around the lens 14 to protect the lens and to secure the lens in position with respect to the base 12. The lens support 16 includes a first post 16A on the right side of the lens and a second post 16B on the left side of the lens. The lens support includes a cross member 16C extending between upper ends of the posts 16A, 16B. Other configurations of lens supports can be used without departing form the scope of the present disclosure.

Some conventional firearm sights (e.g., red dot sights) have mounting structure (sometimes called "footprints") that interface with a mounting plate for mounting the sight on the firearm. The mounting plates facilitate the mounting of the firearm sight to the firearm. The mounting plate is secured to the firearm, and the firearm sight is secured to the mounting plate to connect the sight to the firearm. The mounting structure of the conventional firearm sight is typically on the underside of the base of the firearm sight.

Figure 4:
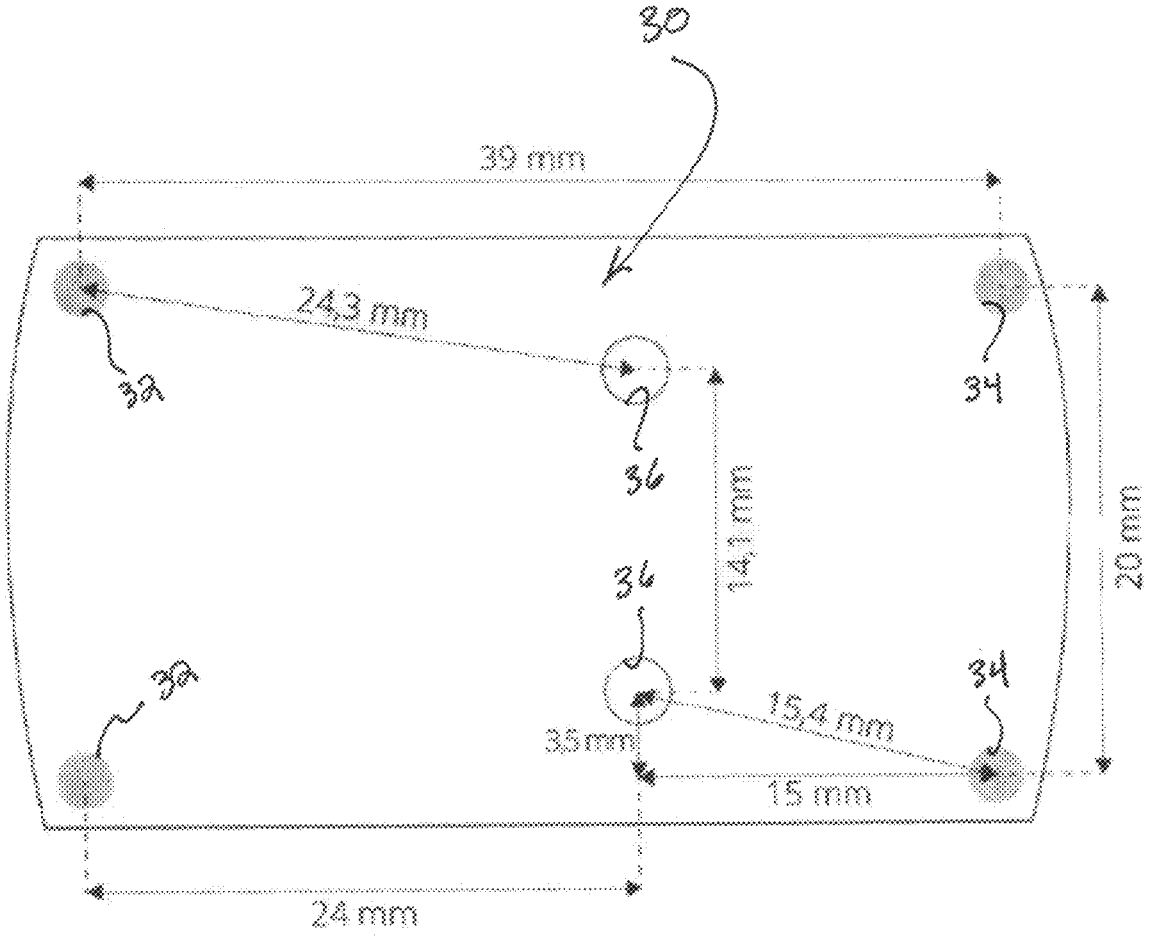
FIG. 4 is a schematic of a first conventional mounting structure for a firearm sight.
Figure 5:
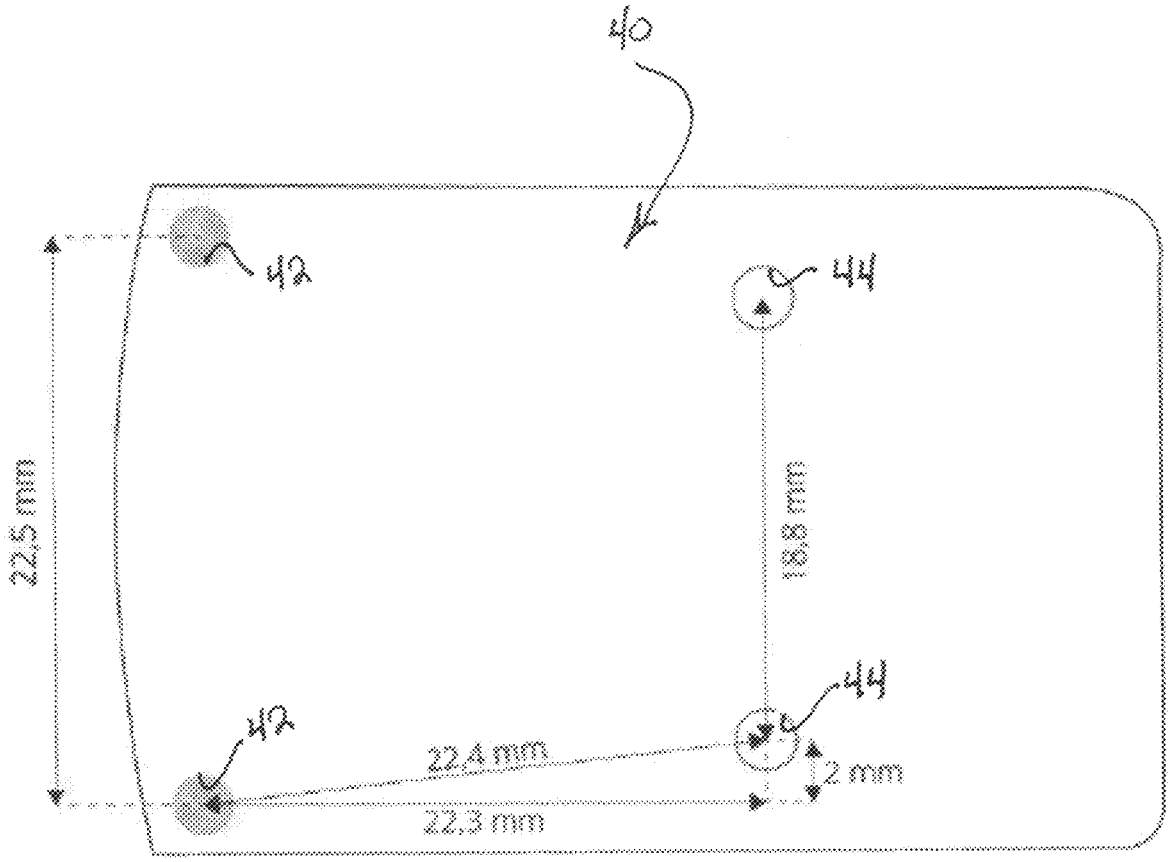
FIG. 5 is a schematic of a second conventional mounting structure for a firearm sight.

There are several different industry standards for mounting structure for firearm sights. Each of these mounting structures is used with a corresponding mounting plate. Accordingly, each conventional mounting structure can be used with one type of mounting plate. Two types of conventional mounting structures used on conventional firearm sights are shown in FIGS. 4 and 5. Referring to FIG. 4, one type of conventional mounting structure 30, which can be referred to as a Docter™ Sight Mounting Footprint, includes four sockets 32, 34 and two holes 36 that are sized, shaped, and positioned as shown. The sockets 32, 34 are 3 millimeters in diameter, and the holes 36 are 3.6 millimeters in diameter. Various other dimensions such as dimensions between sockets and holes are indicated in FIG. 4. Referring to FIG. 5, another type of conventional mounting structure 40, which can be referred to as a Trijicon™ RMR Mounting Footprint, includes two sockets 42 and two holes 44 that are sized, shaped, and positioned as shown. The sockets 42 are 3.9 millimeters in diameter, and the holes 44 are 3.9 millimeters in diameter. Various other dimensions such as dimensions between various sockets and holes are indicated in FIG. 5.

The conventional mounting plates (not shown) for use with the Docter™ Sight Mounting Footprint 30 and the Trijicon™ RMR Mounting Footprint 40 have corresponding alignment bosses that are received in each of the sockets 32, 34, 42 of the respective Docter™ Sight Mounting Footprint or Trijicon™ RMR Mounting Footprint. Similarly, the conventional mounting plates have mounting holes that align with the holes 36, 44 of the respective Docter™ Sight Mounting Footprint or Trijicon™ RMR Mounting Footprint when the conventional mounting plate is secured to said respective Docter™ Sight Mounting Footprint or Trijicon™ RMR Mounting Footprint. The aligned holes generally permit fasteners (e.g., screws) to extend therethrough to attach the sight (which has the mounting structure/footprint) to the conventional mounting plate and/or firearm.

A mounting adaptor or mount (e.g., mounting plate) for use with a firearm accessory having a Docter™ Sight Mounting Footprint is herein called an Alpha Mounting Adaptor (broadly, first mounting adaptor) or an Alpha Mount, and a mounting adaptor or mount (e.g., mounting plate) for use with a firearm accessory having a Trijicon™ RMR Mounting Footprint is herein called a Bravo Mounting Adaptor (broadly, second mounting adaptor) or a Bravo Mount. As used herein, an Alpha Mounting Adaptor and Alpha Mount is defined as including alignment bosses and holes sized, shaped, and arranged to align with (and in the case of the bosses, mate) with the sockets and holes, respectively, of the Docter™ Sight Mounting Footprint 30 shown in FIG. 4 and described above, and a Bravo Mounting Adaptor and Bravo Mount is defined as including alignment bosses and holes sized, shaped, and arranged to align with (and in the case of the bosses, mate) with the sockets and holes, respectively, of the Trijicon™ RMR Mounting Footprint 40 shown in FIG. 5 and described above.

The firearm sight 10 of the present disclosure comprises mounting structure 50 compatible with, or selectively usable with, different types (e.g., two or more types) of mounting adaptors (e.g., different conventional mounting plates). This allows the firearm sight 10 to be used with different mounting plates without needing further adapter plates. In the illustrated embodiment, the mounting structure 50 of the firearm sight 10 is compatible with both the Alpha (Docter™) Mounting Adaptor and the Bravo (Trijicon™ RMR) Mounting Adaptor. It is understood the mounting structure can have other configurations to be secured to other types/styles of mounting plates.

Figure 3:
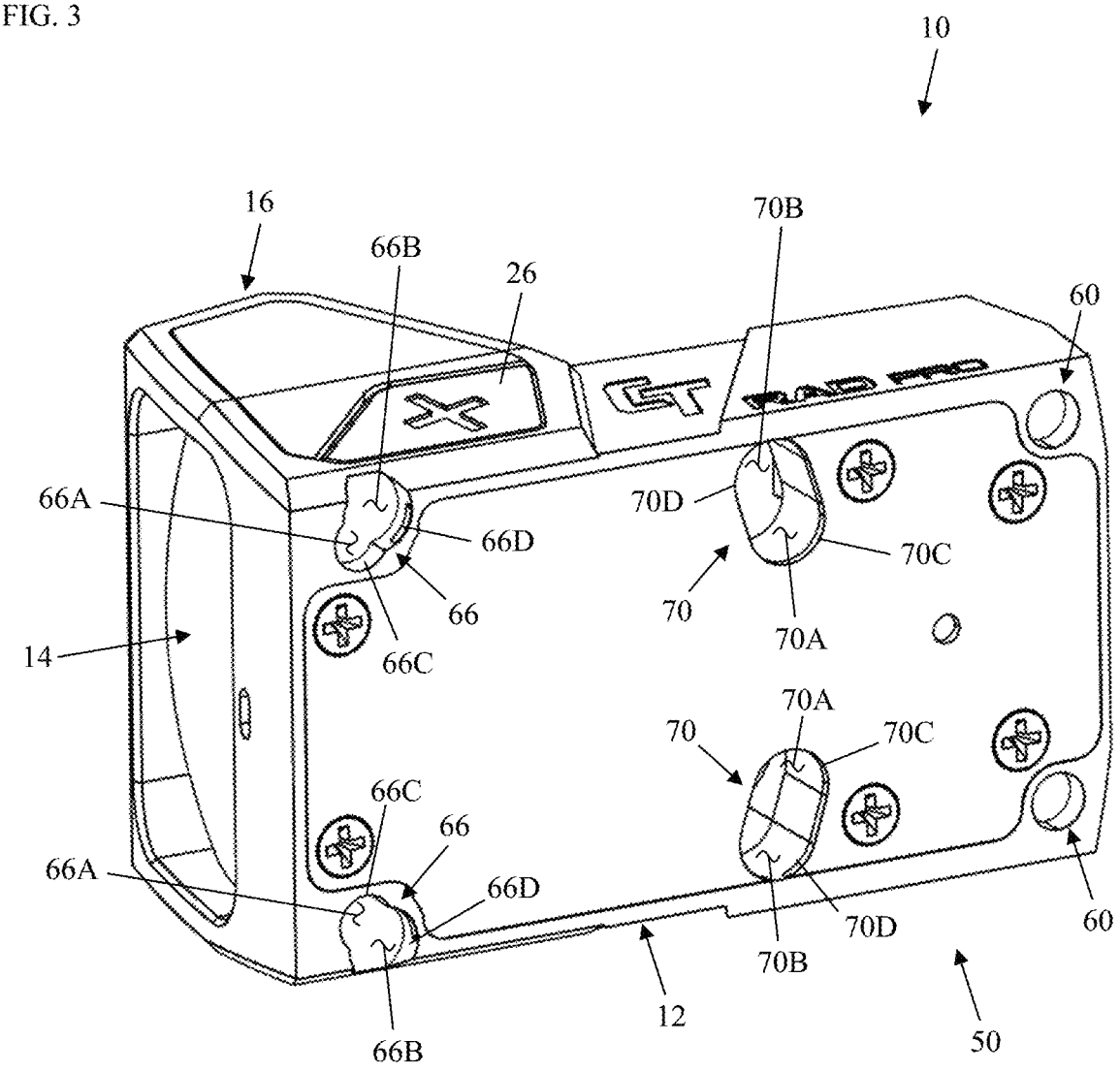
FIG. 3 is a bottom perspective of the firearm accessory.

In the illustrated embodiment, referring to FIG. 3, the mounting structure 50 (mounting footprint of the sight 10) includes two sockets 60 (broadly, first sockets) that are sized, shaped and positioned to receive two of the four alignment bosses of the Alpha (Docter™ style) Mounting Adaptor. Each first socket 60 has the same size and shape as the sockets of the conventional Docter™ Sight Mounting Footprint. The mounting structure 50 further includes two combination sockets 66 (broadly, second sockets) that are sized, shaped and positioned to receive the other two of the four alignment bosses of the Alpha (Docter™ style) Mounting Adaptor or the two alignment bosses of the Bravo (Trijicon™ RMR style) Mounting Adaptor. The mounting structure 50 also includes two combination holes 70 that are sized, shaped and positioned to be aligned with (broadly, in registration with) the two holes of the Alpha (Docter™ style) Mounting Adaptor or the Bravo (Trijicon™ RMR style) Mounting Adaptor. Other configurations can be used without departing from the scope of the present disclosure. For example, the sockets can be in the form of other types of openings, such as through openings that extend through the base, or open-sided openings.

Figure 6:
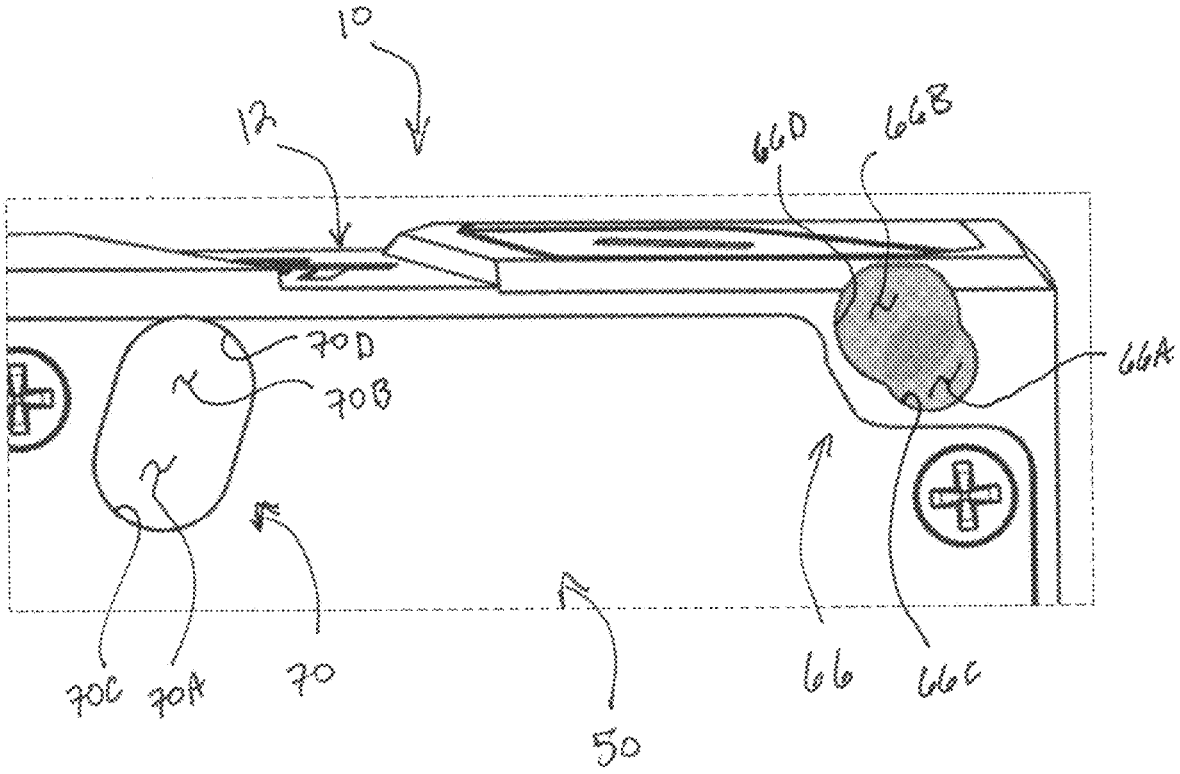
FIG. 6 is an enlarged, fragmentary bottom view of the firearm accessory schematically indicating mounting options.

The two combination sockets 66 are generally identical (e.g., mirror images of one another). Each combination socket 66 has a first section 66A positioned to receive one of the alignment bosses of the Alpha (Docter™ style) Mounting Adaptor and a second section 66B positioned to receive one of the alignment bosses of the Bravo (Trijicon™ RMR style) Mounting Adaptor. The two sections 66A, 66B are bounded by respective arcuate edge segments 66C, 66D of the socket, and the two sections of the combination socket overlap each other (FIG. 6). Desirably, edge segments 66C, 66D surrounding the sections 66A, 66B of the combination socket 66 closely conform to the size and shape of the corresponding portions of the alignment bosses of the Alpha (Docter™ style) Mounting Adaptor and the Bravo (Trijicon™ RMR style) Mounting Adaptor. This enables the edge segments 66C, 66D to contact the alignment bosses inserted into the combination socket 66 to help prevent the mounting structure 50 and mounting adaptor from moving relative to each other during operation of the firearm. Other configurations can be used without departing from the scope of the present disclosure. For example, the sockets can be in the form of other types of openings, such as through openings that extend through the base, or open-sided openings. Moreover, it will be appreciated that the socket sections can have a size and/or shape not corresponding to the size and/or shape of the corresponding mounting adaptor alignment boss, but still be configured to engage the alignment boss to cause alignment of the firearm accessory with respect to the mounting adaptor, such as by engagement of one or more edges of a square shaped hole (or other regular or irregular shaped hole) with the alignment boss.

Figure 7:
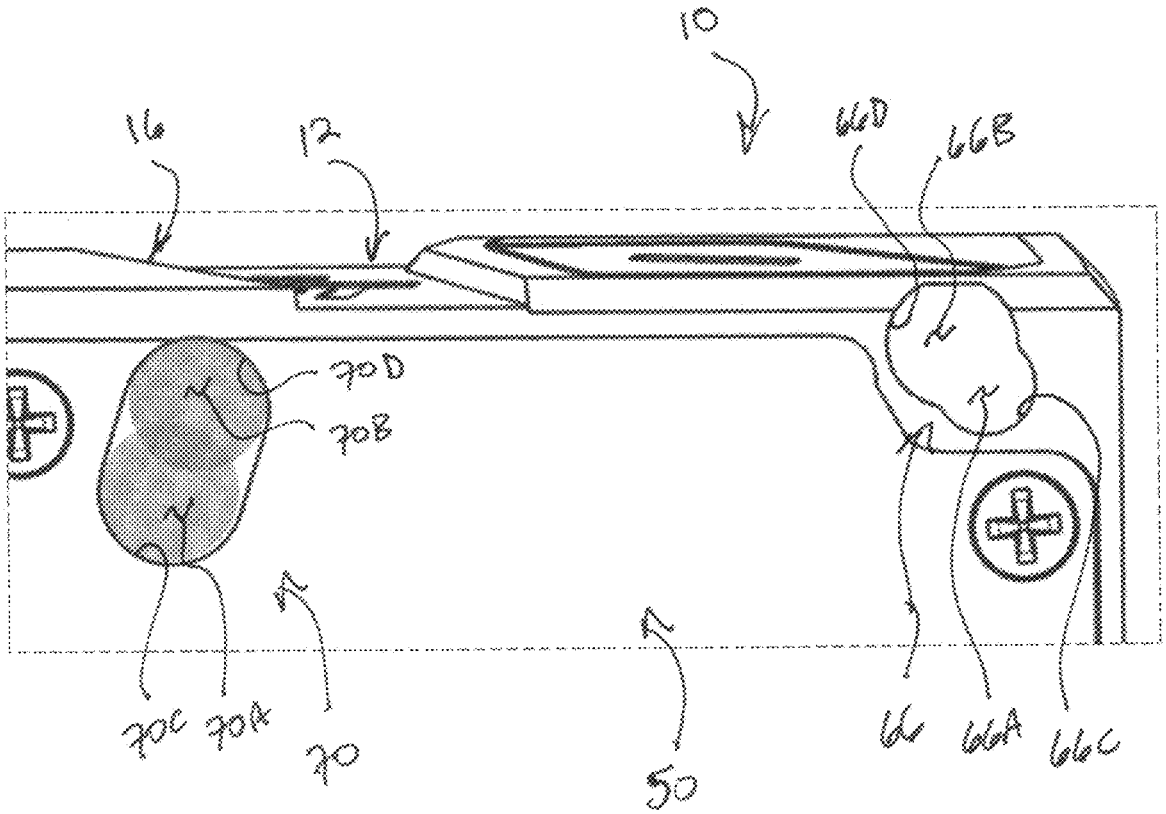
FIG. 7 is an enlarged, fragmentary bottom view of the firearm accessory schematically indicating mounting options.

The two combination holes 70 are generally identical (e.g., mirror images of one another). Each combination hole 70 (broadly, opening) is generally a slot with a first section 70A (e.g., end portion) positioned to be aligned with one of the mounting holes of the Alpha (Docter™ style) Mounting Adaptor and a second section 70B (e.g., the opposite end portion) positioned to be aligned with one of the mounting holes of the alignment bosses of the Bravo (Trijicon™ RMR style) Mounting Adaptor. The two sections 70A, 70B of the combination hole 70 overlap each other (FIG. 7). Desirably, edge segments 70C, 70D surrounding the sections 70A, 70B of the combination hole 70 closely conform to the size and shape of the corresponding portions of the mounting holes of the Alpha (Docter™ style) Mounting Adaptor and the Bravo (Trijicon™ RMR style) Mounting Adaptor. This permits the fasteners to be inserted through the holes, and permits the fasteners through the holes in the mounting adaptor and mounting structure 50 of the firearm sight to help prevent the firearm accessory and mounting adaptor from moving relative to each other during operation of the firearm. Other configurations can be used without departing from the scope of the present disclosure. For example, it will be appreciated that the holes of the mounting footprint of the firearm accessory could have other shapes and/or other sizes than the holes of the mounting adaptor but still be configured to be in registration with the holes of the mounting adaptor when the firearm accessory and mounting adaptor are connected.

Figure 8:
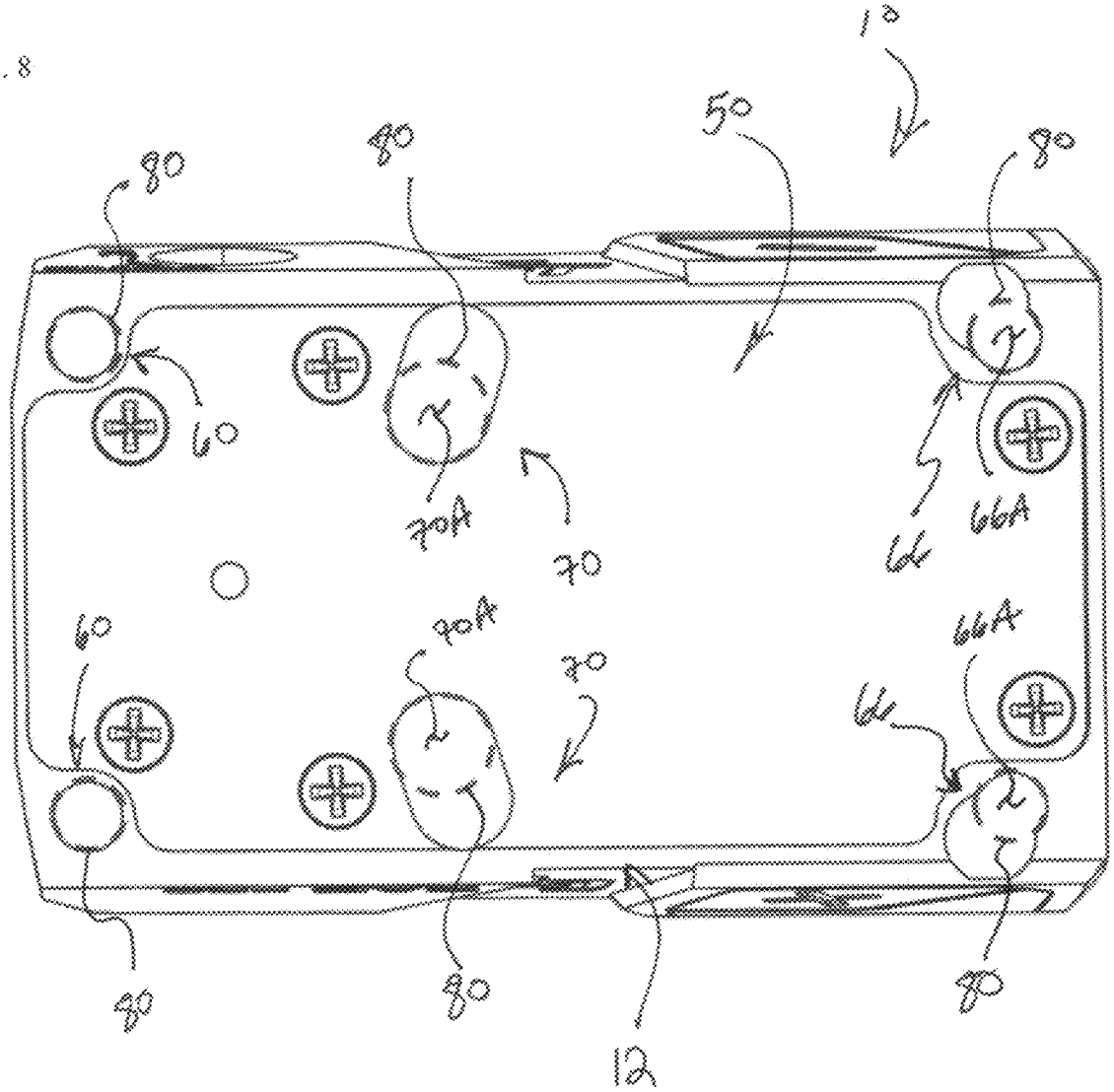
FIG. 8 is a bottom view of the firearm accessory schematically indicating a first mounting configuration.

Referring to FIG. 8, the dashed line circles 80 indicate what portions of the mounting structure 50 are used when the mounting structure is connected to the Alpha (Docter™ style) Mounting Adaptor. The two first sockets 60 are used (occupied by alignment bosses of the Alpha Mounting Adaptor). In addition, the first sections 66A of the combination sockets 66 are used (occupied by alignment bosses of the Alpha Mounting Adaptor), and the first sections 70A of the combination holes 70 are used (occupied by fasteners through the holes).

Figure 9:
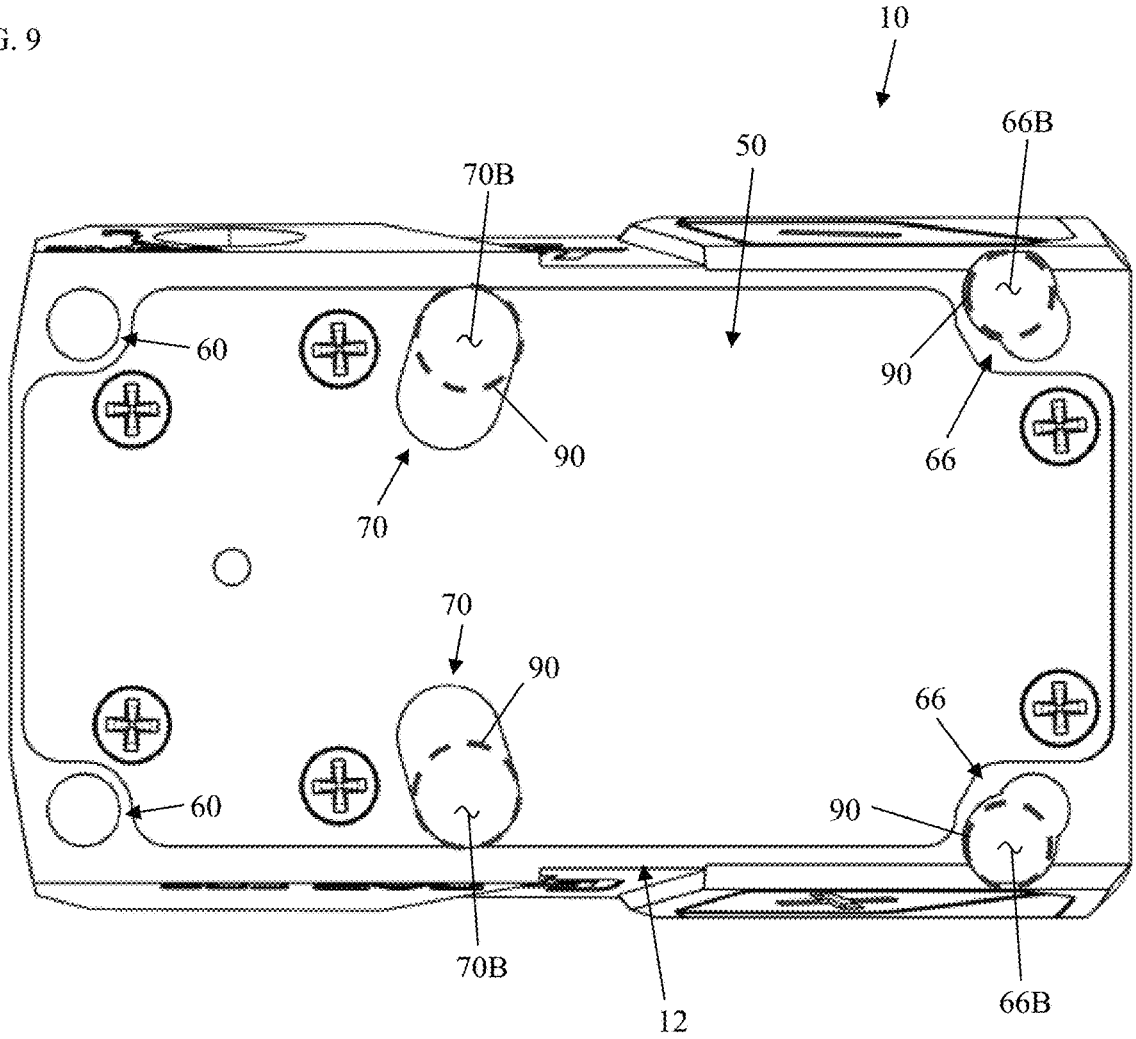
FIG. 9 is a bottom view of the firearm accessory schematically indicating a second mounting configuration.

Referring to FIG. 9, the dashed line circles 90 indicate what portions of the mounting structure 50 are used when the mounting structure is connected to the Bravo (Trijicon™ RMR style) Mounting Adaptor. The two first sockets 60 are not used (unoccupied by alignment bosses of the Bravo Mounting Adaptor). However, the second sections 66B of the combination sockets 66 are used (occupied by alignment bosses of the Bravo Mounting Adaptor), and the second sections 70B of the combination holes 70 are used (occupied by fasteners through the holes).

It will be apparent that modifications and variations are possible without departing from the scope of the invention defined in the appended claims. For example, mounting structure having other configurations (e.g., lacking sockets and/or holes) can be used without departing from the scope of the present disclosure. Moreover, it will be understood that a mounting adaptor could be part of the firearm or a separate component connectable to the firearm. The dimensions and proportions described herein are by way of example without limitation unless otherwise noted. Other dimensions and proportions can be used without departing from the scope of the present disclosure.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A firearm sight selectively usable with a first firearm sight connection structure and a second firearm sight connection structure for connecting the firearm sight to a firearm, the second firearm sight connection structure being differently configured compared to the first firearm sight connection structure, the firearm accessory comprising:

a base including mount connection structure configured to selectively connect to the first firearm sight connection structure and the second firearm sight connection structure to permit mounting of the firearm sight on a firearm, the mount connection structure including a hole extending through the base, the hole being configured to receive a first fastener when the firearm sight is mounted on the firearm using the first firearm sight connection structure and being configured to receive a second fastener when the firearm sight is mounted on the firearm using the second firearm sight connection structure; and a sighting portion supported by the base, the sighting portion being configured to assist a shooter of the firearm in aiming the firearm.

2. The firearm sight of claim 1, wherein the hole is sized and shaped to receive the first fastener at a first position within the hole when the firearm sight is mounted on the firearm using the first firearm sight connection structure and to receive the second fastener at a second position within the hole when the firearm sight is mounted on the firearm using the second firearm sight connection structure.

3. The firearm sight of claim 1, wherein the hole includes a first hole section and a second hole section, the first hole section being configured to receive the first fastener for mounting the firearm sight on the firearm using the first firearm sight connection structure, and the second hole section being configured to receive the second fastener for mounting the firearm sight on the firearm using the second firearm sight connection structure.

4. The firearm sight of claim 3, wherein the first and second hole sections partially overlap.

5. The firearm sight of claim 3, wherein the hole includes a first edge segment bordering the first hole section and a second edge segment bordering the second hole section, the first edge segment being configured to engage the first fastener when the firearm sight is mounted on the firearm using the first firearm sight connection structure, the second edge segment being configured to engage the second fastener when the firearm sight is mounted on the firearm using the second firearm sight connection structure.

6. The firearm sight of claim 5, wherein the first edge segment is configured to be free of engagement with the second fastener when the firearm sight is mounted on the firearm using the second firearm sight connection structure, and the second edge segment is configured to be free of engagement with the first fastener when the firearm sight is mounted on the firearm using the first firearm sight connection structure.

7. The firearm sight of claim 3, wherein the hole includes a first edge segment bordering the first hole section and a second edge segment bordering the second hole section, the first and second edge segments each having a partially circular cross-sectional shape.

8. The firearm sight of claim 7, wherein the first and second edge segments each have a semi-circular cross-sectional shape.

9. The firearm sight of claim 1, wherein the hole comprises a slot.

10. The firearm sight of claim 9, wherein the slot is arranged at a skew angle relative to a sighting axis of the sighting portion along which the user looks to aim the firearm using the firearm sight.

11. The firearm sight of claim 1, wherein the hole is a first hole, and wherein the mount connection structure includes a second hole extending through the base, the second hole being configured to receive a third fastener when the firearm sight is mounted on the firearm using the first firearm sight connection structure and being configured to receive a fourth fastener when the firearm sight is mounted on the firearm using the second firearm sight connection structure.

12. The firearm sight of claim 11, wherein the second hole is a mirror image of the first hole.

13. The firearm sight of claim 1, wherein the sighting portion defines a sighting axis along which the user looks forward through to aim the firearm using the firearm sight, the mount connection structure including a socket disposed on an underside of the base, the socket being disposed forward of the hole.

14. The firearm sight of claim 13, wherein the socket is configured to receive the first firearm sight connection structure of the first mount when the firearm sight is mounted on the firearm using the first sight connection structure, and the socket is configured to receive the second firearm sight connection structure of the second mount when the firearm sight is mounted on the firearm using the second sight connection structure.

15. The firearm sight of claim 14, wherein the socket is a first socket, and wherein the mount connection structure including a second socket disposed on the underside of the base, the second socket being disposed rearward of the hole.

16. The firearm sight of claim 15, wherein the second socket is configured to receive the first firearm sight connection structure of the first mount when the firearm sight is mounted on the firearm using the first sight connection structure.

17. The firearm sight of claim 16, wherein the second socket has a circular cross-sectional shape.

18. The firearm sight of claim 15, wherein the first socket includes a first socket section and a second socket section, the first socket section being configured to receive the first firearm sight connection structure for mounting the firearm sight on the firearm using the first firearm sight connection structure, and the second socket section being configured to receive the second firearm sight connection structure for mounting the firearm sight on the firearm using the second firearm sight connection structure.

19. The firearm sight of claim 1, wherein the sighting portion comprises a red dot sighting portion.

20. The firearm sight of claim 1, wherein the sighting portion includes a lens and a lens support connected to the base, the lens support securing the lens in position with respect to the base.

* * * * *